US008283974B2

(12) United States Patent
Chu et al.

(10) Patent No.: US 8,283,974 B2
(45) Date of Patent: Oct. 9, 2012

(54) FAST START-UP LOW-VOLTAGE BANDGAP REFERENCE VOLTAGE GENERATOR

(75) Inventors: Kwan-Jen Chu, Hsinchu (TW); Nien-Hui Kung, Toufen Township, Miaoli County (TW); Hsuan-Kai Wang, Banqiao (TW)

(73) Assignee: Richtek Technology Corp., Hsinchu (TW)

( * ) Notice: Subject to any disclaimer, the term of this patent is extended or adjusted under 35 U.S.C. 154(b) by 93 days.

(21) Appl. No.: 12/984,088

(22) Filed: Jan. 4, 2011

(65) Prior Publication Data

US 2011/0169561 A1 Jul. 14, 2011

(30) Foreign Application Priority Data

Jan. 12, 2010 (TW) ..... 99100679 A

(51) Int. Cl.
*G05F 1/10* (2006.01)

(52) U.S. Cl. ..... 327/539

(58) Field of Classification Search ..... 327/512, 327/513, 539

See application file for complete search history.

(56) References Cited

U.S. PATENT DOCUMENTS

| | | | | |
|---|---|---|---|---|
| 5,666,046 | A * | 9/1997 | Mietus | 323/313 |
| 6,563,371 | B2 * | 5/2003 | Buckley et al. | 327/539 |
| 6,906,581 | B2 * | 6/2005 | Kang et al. | 327/539 |
| 7,119,528 | B1 * | 10/2006 | Rasmus | 323/317 |
| 7,411,443 | B2 * | 8/2008 | Ivanov et al. | 327/539 |
| 7,495,505 | B2 * | 2/2009 | Chang et al. | 327/539 |
| 7,511,567 | B2 * | 3/2009 | Yeo et al. | 327/539 |
| 7,570,107 | B2 * | 8/2009 | Kim et al. | 327/539 |
| 7,737,768 | B2 * | 6/2010 | Byeon | 327/539 |
| 7,902,913 | B2 * | 3/2011 | Ogiwara et al. | 327/541 |
| 7,944,283 | B2 * | 5/2011 | Kim et al. | 327/539 |
| 7,965,129 | B1 * | 6/2011 | Wadhwa et al. | 327/513 |

* cited by examiner

*Primary Examiner* — Jeffrey Zweizig
(74) *Attorney, Agent, or Firm* — Muncy, Geissler, Olds & Lowe, PLLC

(57) ABSTRACT

A fast start-up low-voltage bandgap reference voltage generator uses two current generators to provide a first current having a positive temperature coefficient and a second current having a negative temperature coefficient, respectively, and a resistor to generate a temperature independent output voltage according to the sum of the first and second currents. The current generator for providing the first current has a self-bias circuit which uses a single MOSFET to establish the first current, and thereby avoids error caused by mismatched MOSFETs.

16 Claims, 4 Drawing Sheets

FAST START-UP LOW-VOLTAGE BANDGAP REFERENCE VOLTAGE GENERATOR

FIELD OF THE INVENTION

The present invention is related generally to a bandgap reference voltage generator and, more particularly, to a fast start-up low-voltage bandgap reference voltage generator.

BACKGROUND OF THE INVENTION

As shown in FIG. 1, a typical bandgap reference voltage generator has a self-bias circuit 10 and a start-up circuit 12 for starting up the bandgap reference voltage generator. In the self-bias circuit 10, two MOSFETs M1 and M2 have control terminals connected to each other and to an output terminal VC of an operational amplifier 14, a resistor R1 and a bipolar junction transistor (BJT) Q1 that is configured as a diode are serially connected between a positive input terminal VA of the operational amplifier 14 and a ground terminal GND, a BJT Q2 that is configured as a diode is connected between a negative input terminal VB of the operational amplifier 14 and the ground terminal GND, a resistor R2 and the MOSFET M1 are serially connected between a power supply terminal VDD and the positive input terminal VA of the operational amplifier 14, and a resistor R3 and the MOSFET M2 are serially connected between the power supply terminal VDD and the negative input terminal VB of the operational amplifier 14. The resistors R2 and R3 have equal resistances. In the start-up circuit 12, a MOSFET M3 is connected between the power supply terminal VDD and the negative input terminal VB of the operational amplifier 14, a MOSFET M4 is connected between the power supply terminal VDD and a control terminal VD of the MOSFET M3 in association with the MOSFET M1 to establish a current mirror, and a MOSFET M5 is connected between the control terminal VD of the MOSFET M3 and the ground terminal GND and has a control terminal connected to the power supply terminal VDD.

When a supply voltage VDD is applied to start the bandgap reference voltage generator of FIG. 1, the MOSFETs M3 and M5 are turned on, the MOSFET M5 is equivalent to a resistor, and the negative input terminal VB of the operational amplifier 14 is connected to the power supply terminal VDD through the MOSFET M3 so that the voltage VB on the negative input terminal is pulled high, causing the output voltage VC of the operational amplifier 14 decreasing and thereby turning on the MOSFET M1 to generate a current I1 that will be mirrored by the MOSFET M4 to generate a current I3 and thus pull high the control terminal voltage VD of the MOSFET M3. Once the voltage VD increases to a certain threshold, the MOSFET M3 is turned off and thus turns off the start-up circuit 12, thereby finishing the start-up process of the bandgap reference voltage generator.

When the bandgap reference voltage generator of FIG. 1 is at steady state, the operational amplifier 14 maintains the voltages of the two input terminals thereof as $$VA=VB=Vbe, \quad \text{[Eq-1]}$$

where Vbe is the emitter-base voltage of the BJT Q2, which has a negative temperature coefficient. The MOSFETs M1 and M2 have equal size, and the BJTs Q1 and Q2 has a size ratio of N:1, so that $$I2=I1=[VT\times\ln(N)]/R1, \quad \text{[Eq-2]}$$

where VT is the thermal voltage, which has a positive temperature coefficient. Since the resistors R2 and R3 have equal resistances, the output terminal 16 of the bandgap reference voltage generator provides an output voltage $$Vbg = I2\times R3 + Vbe = [VT\times\ln(N)\times R2/R1] + Vbe, \quad \text{[Eq-3]}$$

which hints that the temperature coefficient of the voltage Vbg can be zero by adjusting the ratio R2/R1. However, due to Vbe, only when the output voltage Vbg is approximately 1.24 V, can the temperature coefficient be zero, so that the bandgap reference voltage generator of FIG. 1 cannot work under a low power supply voltage, for example, VDD=1V.

FIG. 2 is a conventional low-voltage bandgap reference voltage generator, in which the self-bias circuit 10 of FIG. 1 is modified by moving the resistors R2 and R3 to be respectively connected between the positive input terminal VA of the operational amplifier 14 and the ground terminal GND and between the negative input terminal VB of the operational amplifier 14 and the ground terminal GND, adding a MOSFET M6 and a resistor R4 serially connected between the power supply terminal VDD and the ground terminal GND, and establishing a current mirror by the MOSFETs M1 and M6.

When a supply voltage VDD is applied to start up the bandgap reference voltage generator of FIG. 2, the MOSFETs M3 and M5 are turned on, the negative input terminal voltage VB of the operational amplifier 14 is pulled high, the output voltage VC of the operational amplifier 14 decreases, the MOSFET M1 is turned on to generate a current I5, the MOSFET M4 mirrors the current I5 to generate a current I3, and the voltage VD increases. Once the voltage VD increases to a certain threshold, the MOSFET M3 is turned off and thus turns off the start-up circuit 12, thereby finishing the start-up process of the bandgap reference voltage generator.

When the bandgap reference voltage generator of FIG. 2 is at steady state, the operational amplifier 14 maintains its input voltages VA and VB to be equal to each other as shown in the equation Eq-1, so that the current I4 of the resistor R2 is equal to Vbe/R2, and due to the resistors R2 and R3 having equal resistances, the currents I1 and 12 are equal to each other as shown in the equation Eq-2, resulting in $$I5=I1+I4=VT\times\ln(N)/R1+Vbe/R2. \quad \text{[Eq-4]}$$

If the MOSFETs M1 and M6 have equal size, the output terminal 18 of the bandgap reference voltage generator will provide the output voltage $$Vbg = I6\times R4 = I5\times R4 = (R4/R2)\times[Vbe + VT\times\ln(N)\times(R2/R1)], \quad \text{[Eq-5]}$$

which hints that the output voltage Vbg can be independent of temperature by adjusting the ratio R2/R1, and can be adjusted with its level by adjusting the ratio R4/R2. As illustrated in FIG. 1, to neutralize the negative temperature coefficient of the voltage Vbe and the positive temperature coefficient of the thermal voltage VT, the term Vbe+VT×ln(N)×(R2/R1) in the equation Eq-5 must be approximately 1.24 V. If it is set (R4/R2)=⅔, the output voltage Vbg is approximately 0.8V, and thus the bandgap reference voltage generator of FIG. 2 may still work normally even VDD=1V. However, when the bandgap reference voltage generator of FIG. 2 is just started up, the BJTs Q1 and Q2 that are configured as diodes are not turned on yet, and thus the current of the self-bias circuit totally flows through the resistors R2 and R3. If the start-up circuit 12 is turned off when the BJTs Q1 and Q2 are still off, an incorrect output voltage Vbg will be generated. Therefore, the start-up circuit 12 and the on time of the MOSFET M3 must be carefully designed to enable the bandgap reference voltage generator to be correctly started up, which, however, prolongs the start-up time.

In addition, the self-bias circuit of FIG. 1 needs two MOSFETs M1 and M2 to establish the current I1, and the self-bias circuit of FIG. 2 also needs two MOSFETs M1 and M2 to establish the current I5, so that error may be occurred if the MOSFETs M1 and M2 are not matched to each other.

U.S. Pat. No. 6,906,581 provides a bandgap reference voltage generator that includes two current generators for respectively providing a first current having a positive temperature coefficient and a second current having a negative temperature coefficient, and an output resistor for generating an output voltage independent of temperature according to the first and second currents. Although this bandgap reference voltage generator may work when the supply voltage is lower than 1.24 V, and may be started up fast, the self-bias circuit thereof still needs two MOSFETs to establish the first current having the positive temperature coefficient, so that error still may be occurred if the two MOSFETs are not matched to each other.

SUMMARY OF THE INVENTION

An object of the present invention is to provide a fast start-up low-voltage bandgap reference voltage generator.

According to the present invention, a fast start-up low-voltage bandgap reference voltage generator uses a first current generator having a self-bias circuit for providing a first current having a positive temperature coefficient, a second current generator for providing a second current having a negative temperature coefficient, a current summation circuit for generating a summed current equal to the sum of the first and second currents, and an output resistor for generating an output voltage independent of temperature according to the summed current. The self-bias circuit includes a first MOSFET having an output terminal for providing the first current, an operational amplifier having an output terminal connected to a control terminal of the first MOSFET, a first BJT configured as a diode, a first resistor connected between a first input terminal of the first operational amplifier and the first BJT, a second resistor connected between the output terminal of the first MOSFET and the first input terminal of the first operational amplifier, a third resistor connected between the output terminal of the first MOSFET and a second input terminal of the first operational amplifier, and a second BJT configured as a diode connected to the second input terminal of the first operational amplifier.

BRIEF DESCRIPTION OF THE DRAWINGS

These and other objects, features and advantages of the present invention will become apparent to those skilled in the art upon consideration of the following description of the preferred embodiments of the present invention taken in conjunction with the accompanying drawings, in which.

DETAILED DESCRIPTION OF THE INVENTION

Figure 1:
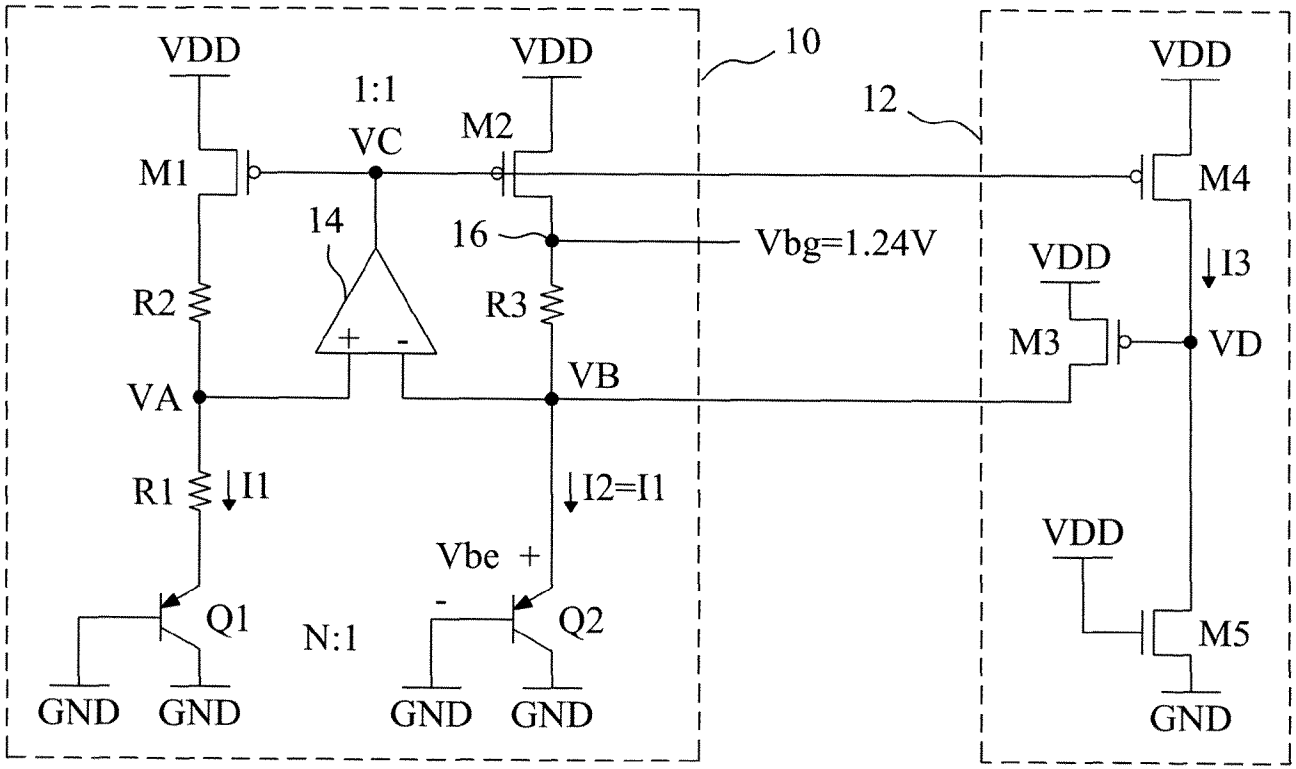
Fig. 1 Prior Art
FIG. 1 is a circuit diagram of a typical bandgap reference voltage generator.
Figure 2:
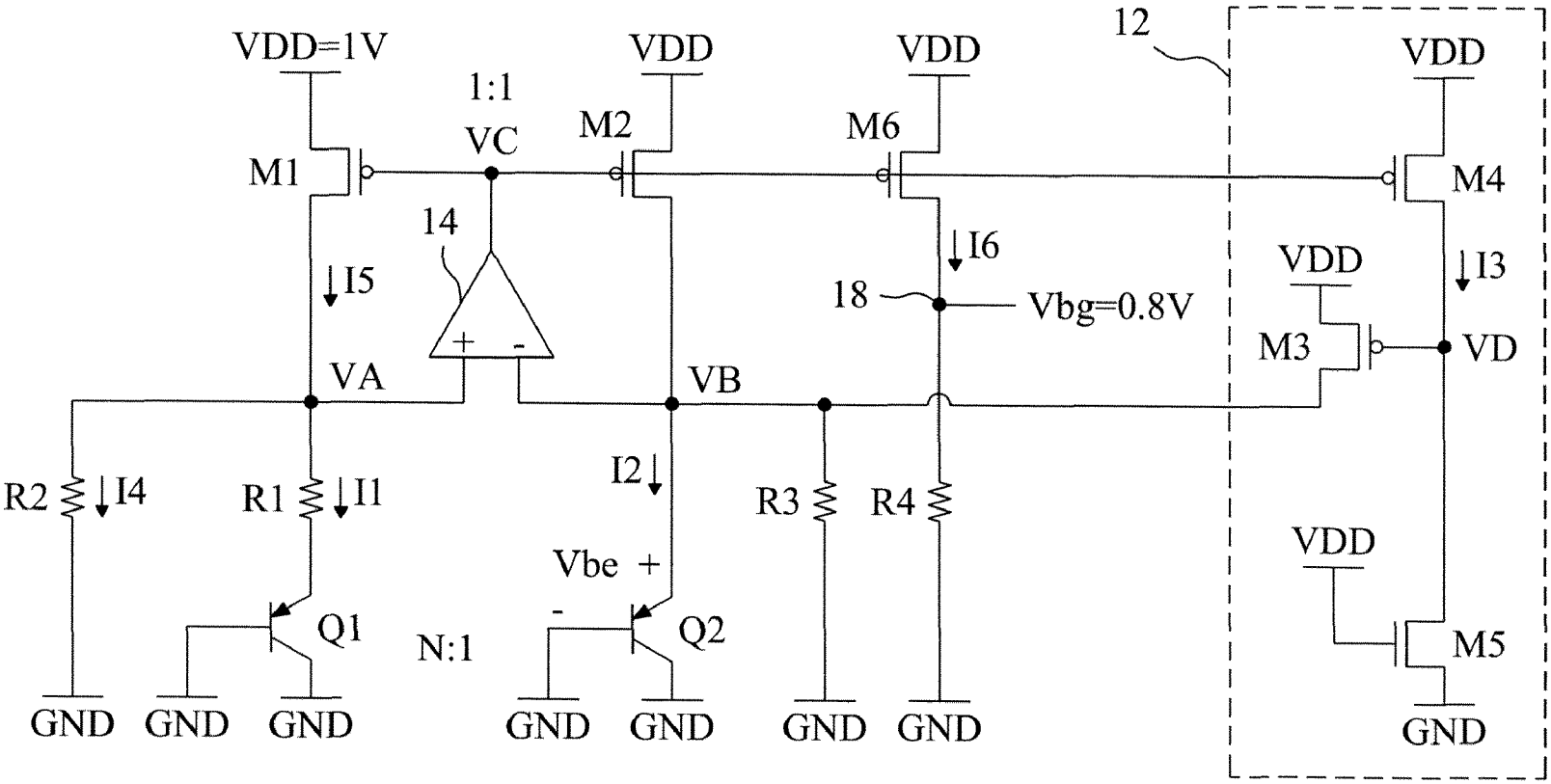
Fig. 2 Prior Art
FIG. 2 is a circuit diagram of a conventional low-voltage bandgap reference voltage generator.
Figure 3:
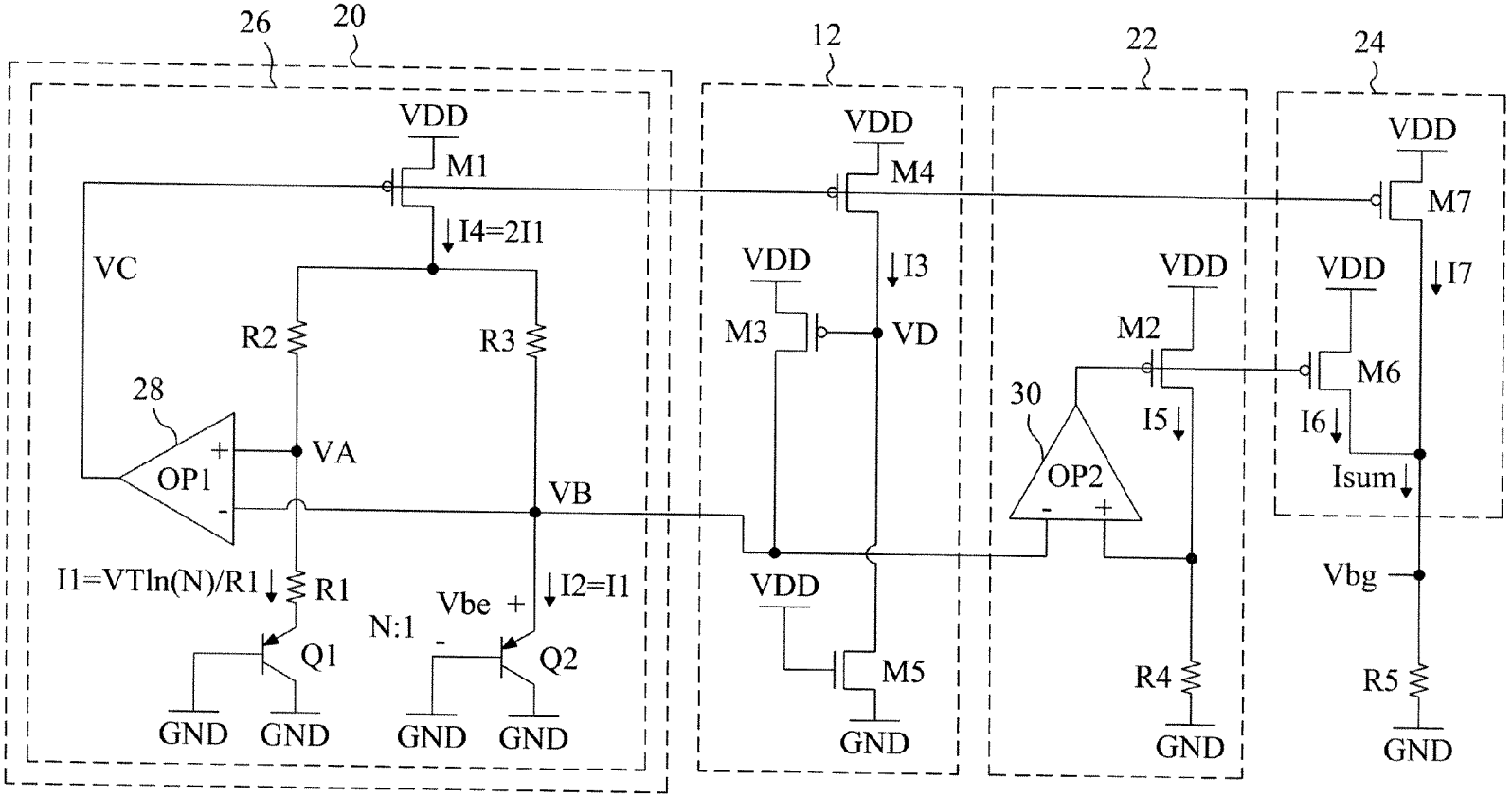
FIG. 3 is a circuit diagram of a first embodiment according to the present invention.

FIG. 3 is a circuit diagram of a first embodiment according to the present invention, in which two current generators 20 and 22, a current summation circuit 24 and an output resistor R5 are combined with the start-up circuit 12 of FIG. 1. The current generator 20 includes a self-bias circuit 26, in which a MOSFET M1 has an input terminal connected to a power supply terminal VDD, an operational amplifier 28 has an output terminal VC connected to a control terminal of the MOSFET M1, a BJT Q1 is configured as a diode, a resistor R1 is connected between a positive input terminal VA of the operational amplifier 28 and the BJT Q1, a resistor R2 is connected between an output terminal of the MOSFET M1 and the positive input terminal VA of the operational amplifier 28, a resistor R3 having a resistance equal to that of the resistor R2 is connected between the output terminal of the MOSFET M1 and a negative input terminal VB of the operational amplifier 28, and a BJT Q2 is configured as a diode connected to the negative input terminal VB of the operational amplifier 28. In the current generator 22, a MOSFET M2 has an input terminal connected to the power supply terminal VDD, a control terminal connected to an output terminal of an operational amplifier 30, and an output terminal connected to a positive input terminal of the operational amplifier 30 and a resistor R4, and a negative input terminal of the operational amplifier 30 is connected to the negative input terminal VB of the operational amplifier 28. In other embodiments, the negative input terminal of the operational amplifier 30 may be connected to the positive input terminal VA of the operational amplifier 28 or the output terminal of the MOSFET M1. In the current summation circuit 24, a MOSFET M6 has an input terminal connected to the power supply terminal VDD, a control terminal connected to the control terminal of the MOSFET M2, and an output terminal connected to the output resistor R5, and a MOSFET M7 has an input terminal connected to the power supply terminal VDD, a control terminal connected to the control terminal of the MOSFET M1, and an output terminal connected to the output resistor R5.

When the bandgap reference voltage generator of FIG. 3 is started up, the MOSFETs M3 and M5 are turned on, the MOSFET M3 connects the negative input terminal VB of the operational amplifier 28 to the power supply terminal VDD and thus pull high the voltage VB, the output terminal voltage VC of the operational amplifier 28 decreases accordingly, the current I4 of the MOSFET M1 increases as the voltage VC decreases, the MOSFET M4 mirrors the current I4 to generate a current I3, and the control terminal voltage VD of the MOSFET M3 increases as the current I3 increases. Once the voltage VD becomes higher than a certain threshold, the MOSFET M3 is turned off and thus disconnects the negative input terminal VB of the operational amplifier 28 from the power supply terminal VDD, thereby finishing the start-up process of the bandgap reference voltage generator.

When the bandgap reference voltage generator of FIG. 3 is at steady state, the operational amplifier 28 maintains its input voltages VA and VB to be equal to each other, and due to the resistors R2 and R3 having equal resistances, the currents I1 and I2 of the BJTs Q1 and Q2 are equal to each other as shown in the equation Eq-2, resulting in $I4=I1+I2=2\times I1$. The current I1 has a positive temperature coefficient, so the current I4 also has the positive temperature coefficient. In the current generator 22, due to the virtual short circuit between the two input terminals of the operational amplifier 30, the voltages thereon are equal to each other, and thus the voltage VB is applied to the resistor R4 to generate the current I5 flowing through the MOSFET M2. Since the voltage VB is equal to the emitter-base voltage Vbe of the BJT Q2, $I5=Vbe/R4$. The voltage Vbe has a negative temperature coefficient, and thus the current I5 also has the negative temperature coefficient. In the current summation circuit 24, the MOSFET M6 establishes a current mirror because of its common gate to the MOSFET M2 and mirrors the current I5 to generate a current I6, the MOSFET M7 establishes a current mirror because of its common gate to the MOSFET M1 and mirrors the current I4 to generate a current I7, and the currents I6 and I7 are combined to generate a summed current Isum=I6+I7 flowing through the output resistor R5 to generate an output voltage Vbg. If it is set that the MOSFETs M1 and M7 have equal size and the MOSFETs M2 and M6 have equal size, then the output voltage will be $$\begin{aligned} Vbg &= (I6 + I7) \times R5 \\ &= (2 \times I1 + I5) \times R5 \\ &= (R5 / R4) \times [Vbe + VT \times \ln(N) \times (2 \times R4 / R1)], \end{aligned} \quad \text{[Eq-6]}$$

which shows that the output voltage Vbg can be independent of temperature by adjusting the ratio R4/R1, and can be adjusted with its level by adjusting the ratio R5/R4.

Figure 4:
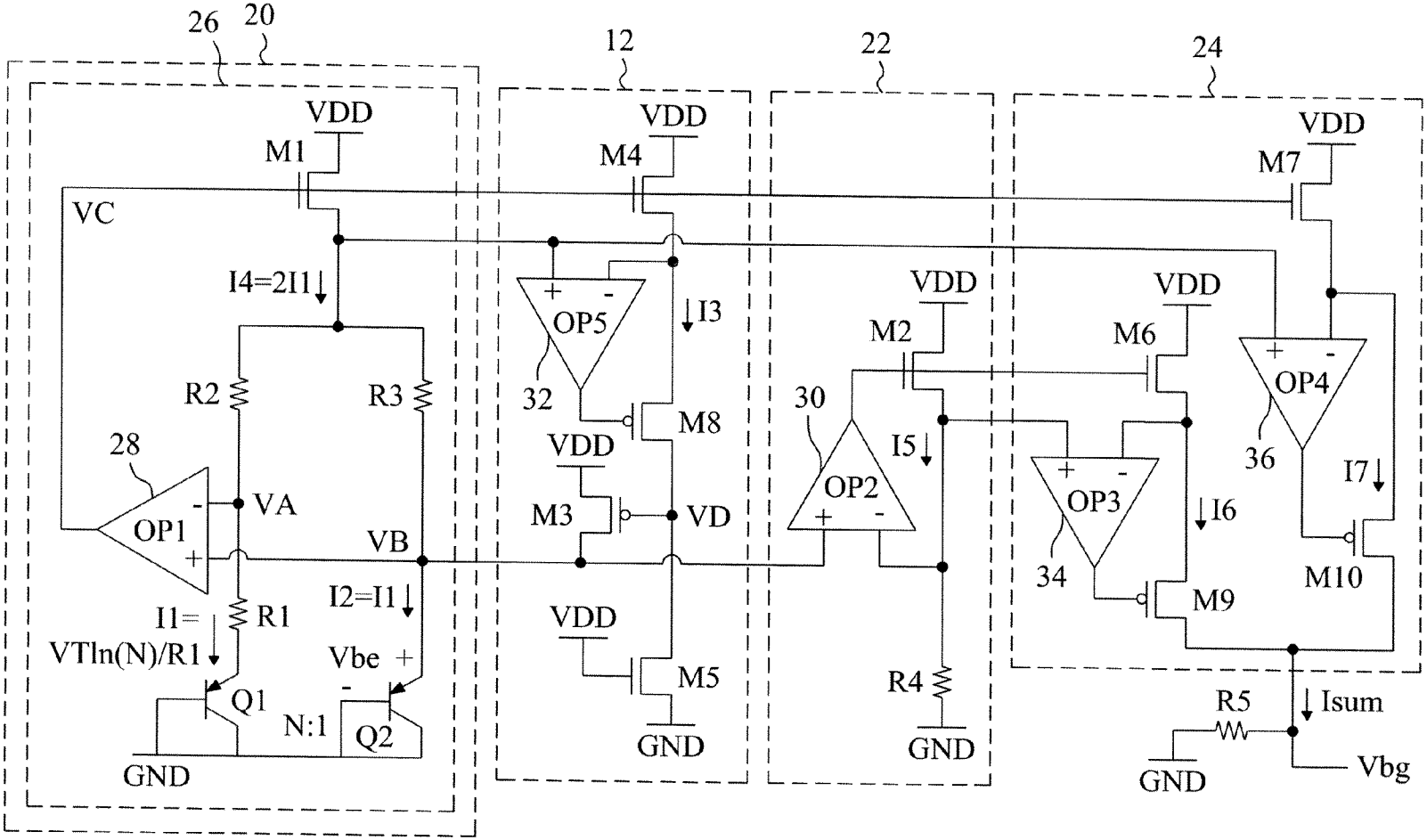
FIG. 4 is a circuit diagram of a second embodiment according to the present invention.

The embodiment of FIG. 3 is slightly modified to be a second embodiment as shown in FIG. 4. In the self-bias circuit 26, the MOSFET M1 is an NMOSFET, the positive input terminal of the operational amplifier 28 is VB, and the negative input terminal is VA. In the current generator 22, the MOSFET M2 is an NMOSFET, and the operational amplifier 30 has a positive input terminal connected to the positive input terminal VB of the operational amplifier 28, and a negative input terminal connected to the output terminal of the MOSFET M2. In the start-up circuit 12, the MOSFET M4 is an NMOSFET, a MOSFET M8 is added between the output terminal of the NMOSFET M4 and the control terminal VD of the MOSFET M3, and an operational amplifier 32 is added and has a positive input terminal connected to the output terminal of the NMOSFET M1, a negative input terminal connected to the output terminal of the NMOSFET M4, and an output terminal connected to the control terminal of the MOSFET M8. In the current summation circuit 24, the MOSFETs M6 and M7 are NMOSFETs, a MOSFET M9 is added between the output terminal of the NMOSFET M6 and the output resistor R5, an operational amplifier 34 is added and has a positive input terminal connected to the output terminal of the NMOSFET M2, a negative input terminal connected to the output terminal of NMOSFET M6, and an output terminal connected to the control terminal of the MOSFET M9, a MOSFET M10 is added between the output terminal of the NMOSFET M7 and the output resistor R5, and an operational amplifier 36 is added and has a positive input terminal connected to the output terminal of the NMOSFET M1, a negative input terminal connected to the output terminal of the NMOSFET M7, and an output terminal connected to the control terminal of the MOSFET M10. In other embodiments, the positive input terminal of the operational amplifier 30 may be connected to the negative input terminal VA of the operational amplifier 28 or the output terminal of the NMOSFET M1.

When the bandgap reference voltage generator of FIG. 4 is started up, the MOSFETs M3 and M5 are turned on, the MOSFET M3 connects the positive input terminal VB of the operational amplifier 28 to the power supply terminal VDD and thus pull high the voltage VB, the output terminal voltage VC of the operational amplifier 28 increases, the current I4 of the NMOSFET M1 increases, the operational amplifier 32 makes the voltages on the output terminals of the NMOSFETs M1 and M4 be equal to each other, the NMOSFET M4 mirrors the current I4 to generate the current I3, and the control terminal voltage VD of the MOSFET M3 increases. Once the voltage VD becomes higher than a certain threshold, the MOSFET M3 is turned off and thus disconnects the positive input terminal VB of the operational amplifier 28 from the power supply terminal VDD, thereby finishing the start-up process of the bandgap reference voltage generator.

When the bandgap reference voltage generator of FIG. 4 is at steady state, due to the virtual short circuit between the two input terminals of the operational amplifier 28, the voltages VA and VB will be equal to each other, and due to the resistors R2 and R3 having equal resistances, the currents I1 and I2 of the BJTs Q1 and Q2 are equal to each other as shown in the equation Eq-2, resulting in I4=I1+I2=2×I1. The current I1 has a positive temperature coefficient, and thus the current I4 also has the positive temperature coefficient. In the current generator 22, due to the virtual short circuit between the two input terminals of the operational amplifier 30, the voltage VB is applied to the resistor R4 to generate the current I5 flowing through the NMOSFET M2, and since the voltage VB is equal to the emitter-base voltage Vbe of the BJT Q2, I5=Vbe/R4. The voltage Vbe has a negative temperature coefficient, and thus the current I5 also has the negative temperature coefficient. In the current summation circuit 24, the operational amplifier 34 makes the voltages on the output terminals of the NMOSFETs M2 and M6 be equal to each other, the NMOSFETs M6 thus establishes a current mirror in association with the NMOSFET M2 to mirror the current I5 to generate the current I6, the operational amplifier 36 makes the voltages on the output terminals of the NMOSFETs M1 and M7 be equal to each other, the NMOSFET M7 thus establishes a current mirror in association with the NMOSFET M1 to mirror the current I4 to generate the current I7, and the currents I6 and I7 are combined to generate a summed current Isum=I6+I7 flowing through the output resistor R5 to generate the output voltage Vbg. If it is set that the NMOSFETs M1 and M7 have equal size and the NMOSFETs M2 and M6 have equal size, then the output voltage Vbg will be as shown in the equation Eq-6.

In the above embodiments, adjusting the ratio R5/R4 may enable the bandgap reference voltage generator to provide a temperature independent output voltage Vbg lower than 1.24 V, and thus the supply voltage VDD may be lower than 1.24 V. In addition, since no resistors are connected in parallel with the BJTs Q1 and Q2, the bandgap reference voltage generator can be started up fast. Further, the self-bias circuit 26 only needs a single MOSFET M1 to establish the current I4 having a positive temperature coefficient, thus preventing error caused by mismatched MOSFETs.

While the present invention has been described in conjunction with preferred embodiments thereof, it is evident that many alternatives, modifications and variations will be apparent to those skilled in the art. Accordingly, it is intended to embrace all such alternatives, modifications and variations that fall within the spirit and scope thereof as set forth in the appended claims.

What is claimed is:

1. A fast start-up low-voltage bandgap reference voltage generator, comprising:

a first current generator having a self-bias circuit, operative to provide a first current having a positive temperature coefficient, the self-bias circuit including:

a first MOSFET having an output terminal for providing the first current;

a first operational amplifier having an output terminal connected to a control terminal of the first MOSFET;

a first BJT configured as a diode;

a first resistor connected between a first input terminal of the first operational amplifier and the first BJT;

a second resistor connected between the output terminal of the first MOSFET and the first input terminal of the first operational amplifier;

a third resistor connected between the output terminal of the first MOSFET and a second input terminal of the first operational amplifier; and a second BJT configured as a diode, connected to the second input terminal of the first operational amplifier;

a second current generator connected to the first current generator, operative to provide a second current having a negative temperature coefficient;

a current summation circuit connected to the first and second current generators, operative to generate a summed current equal to a sum of the first and second currents; and an output resistor connected to the current summation circuit, receiving the summed current to generate an output voltage.

2. The bandgap reference voltage generator of claim 1, wherein the second current generator comprises:

a second operational amplifier having a first input terminal connected to the first or second input terminal of the first operational amplifier or the output terminal of the first MOSFET;

a second MOSFET having an output terminal and a control terminal respectively connected to a second input terminal and an output terminal of the second operational amplifier; and a fourth resistor connected to the second input terminal of the second operational amplifier, determining the second current according to a voltage thereon.

3. The bandgap reference voltage generator of claim 2, wherein the current summation circuit comprises:

a third MOSFET connected to the first current generator to generate a third current according to the first current; and a fourth MOSFET connected to the second current generator to generate a fourth current according to the second current;

wherein the third and fourth currents are combined to generate the summed current.

4. The bandgap reference voltage generator of claim 3, wherein the third MOSFET has a control terminal connected to the control terminal of the first MOSFET.

5. The bandgap reference voltage generator of claim 4, wherein the current summation circuit further comprises:

a fifth MOSFET connected between an output terminal of the third MOSFET and the output resistor; and a third operational amplifier having a first input terminal connected to the output terminal of the first MOSFET, a second input terminal connected to the output terminal of the third MOSFET, and an output terminal connected to a control terminal of the fifth MOSFET.

6. The bandgap reference voltage generator of claim 3, wherein the fourth MOSFET has a control terminal connected to the control terminal of the second MOSFET.

7. The bandgap reference voltage generator of claim 6, wherein the current summation circuit further comprises:

a fifth MOSFET connected between an output terminal of the fourth MOSFET and the output resistor; and a third operational amplifier having a first input terminal connected to the output terminal of the second MOSFET, a second input terminal connected to the output terminal of the fourth MOSFET, and an output terminal connected to a control terminal of the fifth MOSFET.

8. The bandgap reference voltage generator of claim 1, wherein the current summation circuit comprises:

a second MOSFET connected to the first current generator to generate a third current according to the first current; and a third MOSFET connected to the second current generator to generate a fourth current according to the second current;

wherein the third and fourth currents are combined to generate the summed current.

9. The bandgap reference voltage generator of claim 8, wherein the second MOSFET has a control terminal connected to the control terminal of the first MOSFET.

10. The bandgap reference voltage generator of claim 8, wherein the current summation circuit further comprises:

a fourth MOSFET connected between an output terminal of the second MOSFET and the output resistor; and a second operational amplifier having a first input terminal connected to the output terminal of the first MOSFET, a second input terminal connected to the output terminal of the second MOSFET, and an output terminal connected to a control terminal of the fourth MOSFET.

11. The bandgap reference voltage generator of claim 1, further comprising a start-up circuit connected to the first current generator, operative to start up the bandgap reference voltage generator.

12. The bandgap reference voltage generator of claim 11, wherein the start-up circuit comprises a second MOSFET connected to a power supply terminal and the second input terminal of the first operational amplifier, being turned on when the bandgap reference voltage generator is started up, and turned off after a start-up process of the bandgap reference voltage generator is finished.

13. The bandgap reference voltage generator of claim 12, wherein the start-up circuit further comprises a third MOSFET having an output terminal connected to a control terminal of the second MOSFET.

14. The bandgap reference voltage generator of claim 13, wherein the third MOSFET has a control terminal connected to the control terminal of the first MOSFET.

15. The bandgap reference voltage generator of claim 12, wherein the start-up circuit further comprises:

a third MOSFET having a control terminal connected to the control terminal of the first MOSFET;

a fourth MOSFET connected between an output terminal of the third MOSFET and a control terminal of the second MOSFET; and a second operational amplifier having a first input terminal connected to the output terminal of the first MOSFET, a second input terminal connected to the output terminal of the third MOSFET, and an output terminal connected to a control terminal of the fourth MOSFET.

16. The bandgap reference voltage generator of claim 12, wherein the start-up circuit further comprises a third MOSFET having an output terminal connected to a control terminal of the second MOSFET, being turned on when the bandgap reference voltage generator is started up.

* * * * *